United States Patent [19]

Cronauer

[11] Patent Number: 4,595,891

[45] Date of Patent: Jun. 17, 1986

[54] MICROWAVE COMBINER HAVING MEANS TO ISOLATE BETWEEN INPUT TERMINALS

[75] Inventor: Edward A. Cronauer, Massapequa Park, N.Y.

[73] Assignee: United Technologies Corporation, Hartford, Conn.

[21] Appl. No.: 604,568

[22] Filed: Apr. 27, 1984

[51] Int. Cl.[4] ..... H01P 5/16

[52] U.S. Cl. ..... 333/127; 333/128

[58] Field of Search ..... 333/117, 124, 125, 127, 333/128, 130, 136, 123, 126, 129, 134

[56] References Cited

U.S. PATENT DOCUMENTS

| | | | |
|---|---|---|---|
| 3,091,743 | 5/1963 | Wilkinson . | |
| 3,974,465 | 8/1976 | White . | |
| 4,129,839 | 12/1978 | Galani et al. . | |
| 4,240,051 | 12/1980 | Haugsjaa et al. | 333/127 |
| 4,254,386 | 3/1981 | Nemit et al. | 333/128 |
| 4,263,568 | 4/1981 | Nemit | 333/127 |
| 4,543,545 | 9/1985 | Craine et al. | 333/128 |

OTHER PUBLICATIONS

Yee et al., *N-Way TEM-Mode Broad-Band Power Dividers,* IEEE Trans. on MTT, Oct. 1970, pp. 682-688.

Webb, *Power Divider/Combiners: Small Size, Big Specs,* Microwaves, Nov. 1981, pp. 67-74.

*Primary Examiner*—Paul Gensler

*Attorney, Agent, or Firm*—Robert P. Sabath

[57] ABSTRACT

A microwave combiner arrangement for isolatingly combining a plurality of microwave inputs with pairs of isolation resistors, each of the resistors of a pair being combined to a common terminal. The common terminals are in turn interconnected by wavelength-long conductors. Adjacent pairs of inputs are additionally connected by quarter wavelength conductors to corresponding outputs. The outputs are in turn connected in half wavelength connections to a final output terminal.

5 Claims, 3 Drawing Figures

MICROWAVE COMBINER HAVING MEANS TO ISOLATE BETWEEN INPUT TERMINALS

TECHNICAL FIELD

This invention is directed to the art of microwave combiners, and more particularly to the art of microwave combiners in radar transmitters including power amplifiers.

BACKGROUD ART

Microwave combiners of the Wilkinson type are well known. The Wilkinson combiner effectively isolates a number of microwave inputs to be combined by connecting each of the inputs to a common terminal through isolating resistors. The electrical length of the isolating resistors and their connecting paths is approximately zero degrees.

U.S. Pat. No. 3,091,743 assigned to Sylvania Electric Products, Inc. shows one embodiment of the Wilkinson combiner principle. In the embodiment shown in the patent, however, the input connections are physically close enough to one another to permit effective interconnection.

In many cases, known Wilkinson embodiments are difficult to implement practicably. For example, in microstrip configurations, known Wilkinson embodiments are subject to signal crossover, and circuit isolation is thus not effective.

Furthermore, the short electrical length of isolating resistor circuits requires very closely spaced lines in the path from the input ports. This can be a serious restriction on the location of input ports. In many cases, additional losses are faced in connections with ports which are not proximately located.

In some cases in which the number of input ports is appropriate, the Wilkinson type combiner can be reconfigured as a succession of parallel combiners. For example, pairs of adjacent input ports are separated by isolating resistors and quarter wavelength conductors to a common terminal. Then, adjacent pairs of common terminals are in turn isolated by isolating resistors and quarter wavelength conductors each to one of another echelon of common terminals and so on until a single terminal is reached.

However, the wattage rating of the isolating resistors from echelon to echelon progressively increases, because more and more power and increasingly higher voltage levels are present at the common terminals. At some point, the resistance required for isolation will become impracticable. Thus, the size of required resistors may become excessive. Moreover, the problem is exacerbated by the fact that the resistors themselves are by necessity ungrounded, and the larger resistors have higher capacity to ground which increases the insertion losses for the resistor.

Accordingly, it is an object of the present invention to develop a microwave combiner arrangement that provides input power isolation without demanding progressively higher resistance elements in the pairwise combination of adjacent input ports or terminals.

It is an additional object of the present invention to provide adequate isolation between adjacent input power terminals in a manner minimizing °the risk of flashover and short circuits in the combiner circuit where one or more of the inputs is removed or replaced by a random value of impedance.

It is further an object of the invention herein to provide for the practicable combination of microwave power from power amplifier modules stacked vertically within a cabinet, which creates considerable physical separation between the top and bottom modules.

DISCLOSURE OF INVENTION

The instant invention resolves the difficulties and problems noted above and is distinguishable from prior versions of microwave combiners in that it calls for combining the power inputs of a number of individual power sources in a novel fashion described hereafter.

In particular, it is proposed that adjacent pairs of power terminals to be combined actually be connected by a pair of resistors sharing a common terminal therebetween. Next, each of the common terminals therebetween are joined by single wavelength conductors, if the distance between one pair of input ports to another is otherwise one and one-half wavelengths long. This insures isolation between all subsets of ports, and successive isolating resistors are not required.

This eliminates the need for larger value resistors and permits the output sections of the combiner to be used to combine as many inputs as desired.

BRIEF DESCRIPTION OF DRAWING

The invention is best understood in conjunction with the accompanying drawing, which is set forth in several figures in which.

BEST MODE FOR CARRYING OUT THE INVENTION

Figure 1:
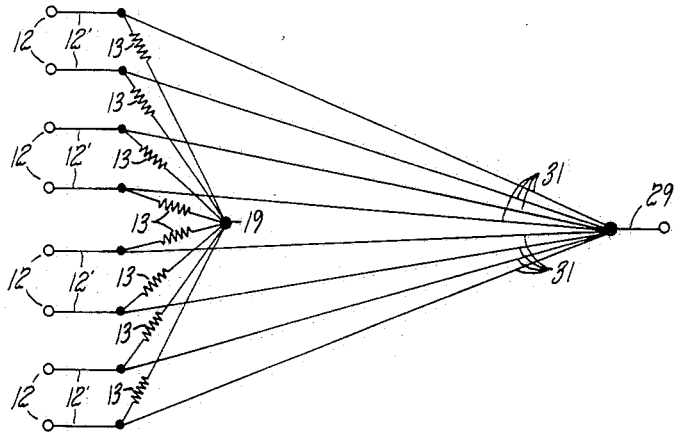
FIG. 1 PRIOR ART
FIG. 1 shows the arrangement of a Wilkinson combiner of the prior art.

FIG. 1 shows a theoretical Wilkinson combiner of the prior art for "n" inputs 12.

In this combiner, "n" fifty ohm inputs 12 can for example be combined with corresponding fifty ohm isolation resistors 13 at one terminal thereof. Next, the other ends of resistors 13 can each be connected to a common terminal 19. Furthermore, each of the inputs 12 is additionally connected to an output terminal 29 through a quarter wavelength conductor element 31 which is preferably also at the fifty ohm level.

This is difficult to accomplish unless the inputs 12 are physically very close to one another. The short electrical length of the isolation resistors 13 forces the electric leads 12' to be very closely spaced to each other, enhancing the likelihood that isolation will be compromised.

Moreover, in a microstrip configuration, isolation of circuits is virtually impossible, making complex constructions to effect signal crossover necessary.

Figure 2:
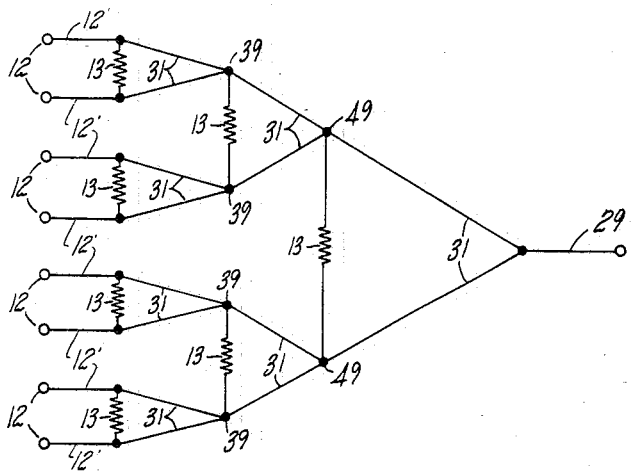
FIG. 2 PRIOR ART
FIG. 2 shows another version of the prior art directed toward a cascaded Wilkinson combiner with eight inputs.

FIG. 2 shows another version of the prior art including a cascaded version of the Wilkinson combiner including eight inputs 12. In this case, the number of inputs 12 is a power of two, permitting the combiner to be configured as a succession of parallel combiners. Isolation is thus established between successive pairs of input ports 12, between the outputs 39 at the ends of quarter wavelength conductor elements 31 leading to pairs of ports 12, and between third echelon outputs 49 at the ends of other quarter wavelength conductor elements 31, as well. Finally, even other quarter wavelength conductor elements 31 lead to combined output 29.

The version of the Wilkinson combiner shown in FIG. 2 is effective in some cases for combining small levels of microwave power. However, as the power from a large number of input ports 12 is successively combined and recombined in successive echelons of circuitry, the values of the isolating resistors 13 must be increased to accommodate progresively higher power and voltage ratings. Very sizeable resistors are required in the final combiner stages. Additionally, since neither terminal of resistors 13 is grounded, and since resistors 13 get progressively larger to handle the required power, the capacity of a resistor 13 to ground gets ever larger, and insertion loss of the combiner continues to increase. This can cause serious problems including a substantial risk of flashover.

Figure 3:
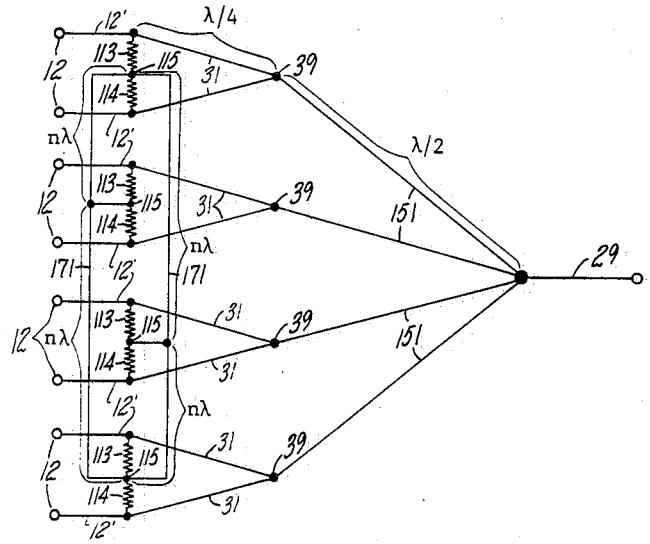
FIG. 3 shows an eight input microwave combiner according to the instant invention.

FIG. 3 shows a version of the microwave combiner according to the invention herein, including eight inputs 12. The inputs 12 are not immediately proximate to one another, which makes it impossible to employ the Wilkinson arrangement of FIG. 1. This embodiment includes isolation resistors 113 and 114 between consecutive inputs 12 connected to a central terminal 115 in each case. Resistors 113 and 114 each have the resistance value seen at input ports 12 which is frequently in the range of fifty ohms. In addition, pairs of input ports 12 are connected through quarter wavelength conductors 31 to common terminals 39. The common terminals 39 are then connected to output terminal 29 through half wavelength conductor elements 151. Each of central terminals 115 is connected by a wavelength long electric lead or conductor 171 to at least another of central terminal 115. Ths insures that the distance from a given one of inputs 12 to a selected other of said inputs 12 is no more than three half wavelengths long, insuring isolation between any of inputs 12 and the output terminal 29 as well as with respect to any of common terminals 39. Accordingly, second echelon isolation resistors as in FIG. 2 are not required.

Accordingly, as can be seen by examining FIG. 3, the difference in separation along several paths between selected ones of inputs 12 is either the same, or half wavelength distance or an integer multiple thereof, thus insuring isolation therebetween.

In a preferred embodiment of the invention, the electric leads or conductors connecting the various resistors 13 and terminals 29, or 39 or otherwise, as the case may be, are preferably of the nature of microstrip circuitry on a suitable substrate. The substrate may for example be a dielectric such as Epsilon 10 ® or Teflon ® fiberglass. The substrate is coated for example with copper or aluminum or another suitable conductive material on both sides. The unneeded conductor coating on one side of the substrate is photolithographically removed to leave only the actual circuit conductors and leads needed for desired circuit connections including for example to connect inputs 12 with isolation resistors 113 and 114. The width of microstrip employed defines the effective resistance of each particular portion of the strip. Further, the dielectric constant of the selected substrate determines what length of conductor will constitute a quarter, half or full wavelength, as the case may be, in the particular material.

Suitable connectors are employed to establish connections with respect to coaxial inputs 12 and the microstrip substrate which may for example be supported by a suitable supporting board for example made out of aluminum.

Suitable RF resistors 12 can be purchased from well known companies such as for example Pyrofilm, Inc. of Whippany, N.J.

A suitable value for resistors 113 and 114 is fifty ohms. The quarter wavelength leads indicated herein are preferably 70.7 ohms in value.

The information above may lead persons skilled in the art to conceive of other embodiments of the invention, which fall within the scope of the invention. Reference to the claims below is accordingly urged, as these specify the metes and bounds of the invention with particularity.

I claim:

1. A microwave combiner arrangement comprising: a plurality of pairs of isolation resistors, each of said pairs effective for isolating adjacent ones of a plurality of pairs of microwave power input terminals, each of the resistors of each pair being substantially equal to the input resistance of a respective one of said input terminals and electrically connected to a corresponding one of a plurality of common terminals at one end, and to a corresponding one of said plurality of input terminals at the other resistor end thereof;

a plurality of pairs of quarter wavelength conductors each for electrically connecting corresponding pairs of input terminals to individual ones of a plurality of corresponding output terminals;

a plurality of half wavelength output conductors for electrically connecting each of said pairs of quarter wavelength means to a final output terminal, said plurality of half wavelength means being additionally effective for connection with a corresponding one of said output terminals; and wavelength conductors for electrically connecting each of said common terminals to at least one other of said common terminals, whereby effective electrical isolation between said input terminals is accomplished.

2. The invention of claim 1, wherein at least one of said wavelength conductors is connected to each of said common terminals.

3. The invention of claim 1, wherein each of said wavelength conductors is connected to two other of said wavelength conductors at respective common terminals.

4. The invention of claim 1, wherein said wavelength conductors include wavelength-long sections connected end on end with respect to one another in the form of at least a single string.

5. The invention of claim 1, wherein said wavelength conductors comprise a ring.

* * * * *